US006491297B1

(12) United States Patent
Cardoso

(10) Patent No.: US 6,491,297 B1
(45) Date of Patent: Dec. 10, 2002

(54) METHOD FOR INCREASING LIKELIHOOD OF LOCATING SOUGHT INDIVIDUALS INCLUDING MISSING PERSONS OR WANTED INDIVIDUALS BY PROVIDING PICTURES OF THE SOUGHT INDIVIDUALS ON LOTTERY GAME CARDS

(76) Inventor: Isaura Gabriela Cardoso, 5460 Lyons Rd. #203, Coconut Creek, FL (US) 33073

( * ) Notice: Subject to any disclaimer, the term of this patent is extended or adjusted under 35 U.S.C. 154(b) by 0 days.

(21) Appl. No.: 09/404,189

(22) Filed: Sep. 24, 1999

(51) Int. Cl.[7] ..... A63F 3/06; G09F 23/14

(52) U.S. Cl. ..... 273/138.1; 273/139; 273/308; 283/77; 283/901; 283/903; D21/376; D21/383; D21/384

(58) Field of Search ..... 283/903, 56, 901, 283/77; 273/139, 292, 308, 138.1; D21/376, 383, 384

(56) References Cited

U.S. PATENT DOCUMENTS

| | | | | | |
|---|---|---|---|---|---|
| 1,593,911 | A | * | 7/1926 | Patterson | 283/56 |
| 2,035,218 | A | * | 3/1936 | Bloom | 283/56 |
| 3,258,277 | A | * | 6/1966 | Schuster | 283/56 |

FOREIGN PATENT DOCUMENTS

| | | | | |
|---|---|---|---|---|
| GB | 2151987 | * | 7/1985 | 283/77 |

* cited by examiner

*Primary Examiner*—Benjamin H. Layno

(57) ABSTRACT

A method of increasing likelihood of locating sought individuals, including missing persons or wanted individuals by stimulating public awareness through the dissemination of pictures and other data or indicia (12) of such individuals on lottery game cards. In addition, a-portion of the card that bears data of an individual being sought is a detachable stub (24) which can be kept as an entry for an additional opportunity to participate in a contest at a later date.

1 Claim, 3 Drawing Sheets

METHOD FOR INCREASING LIKELIHOOD OF LOCATING SOUGHT INDIVIDUALS INCLUDING MISSING PERSONS OR WANTED INDIVIDUALS BY PROVIDING PICTURES OF THE SOUGHT INDIVIDUALS ON LOTTERY GAME CARDS

BACKGROUND—FIELD OF INVENTION

This invention relates to the field of methods used for locating sought individuals, and also to the field of lottery game cards, specifically to a method and lottery game card for increasing the likelihood of locating said individuals.

BACKGROUND—DESCRIPTION OF PROBLEM

A major problem that affects society is that of missing persons, usually abducted children. Another problem is that posed by dangerous criminals wanted by the law and on the loose. Significant efforts and resources are dedicated to disseminating information about such individuals in order to locate them. Unfortunately, recovery rate of missing victims or capture rate of wanted criminals is far from satisfactory.

BACKGROUND—DESCRIPTION OF PRIOR ART

Presently there are different methods used to disseminate images of sought individuals with the purpose of recruiting volunteers from the community to join in the search efforts to locate such individuals by raising awareness in the general public about such persons' likeness in order to increase the likelihood that someone will spot the individual-and ultimately lead to the location and recovery or capture of such individual.

Some of these methods are based on media such as television, radio, newspapers, special brochures, posters, flyers, milk cartons, and more recently, internet web sites, among others.

Television transmissions may reach a large sector of the population to present full color images of the sought person, but for very limited amounts of time given its relatively high costs, thereby reducing retention of the resemblance of the featured individuals. Some television programs, such as AMERICA'S MOST WANTED; dedicate its airtime to diffusing information about dangerous criminals on the loose, and also about missing children. However, once transmission ends; audiences relies solely on memory recall. Additionally, television is limited in its audience reach considering rating competitions and other factors intrinsic to this media.

Another popular media, the radio, is null in its capacity to disseminate visual graphic data, a key driver in facial recognition.

In relation to high tech media used to disseminate data such as web sites and other electronic internet based technologies, the results are not very encouraging either. Even though this particular channel delivers messages selectively and almost immediately, it is not yet massively widespread, and even when it does become so, users will be bombarded with messages of all types. Given the interactive nature of-the internet, users will still have the option of navigating to sites of particular interest, whereby sites delivering information about sought individuals will increasingly need to compete for a web surfer's preference and attention.

One of the most popular and common of these media devices could be the type prepared in printed form such as flyers, posters, milk cartons, newspapers, etc. This particular type of media could possibly achieve the task of disseminating data more cost efficiently than most other media thanks to certain advantages such as a wider availability to the masses as a result of lower production and distribution costs.

However, as the public is often bombarded with messages of all types, most of the aforementioned media devices go unnoticed. Flyers delivered in the mail, for instance, are frequently discarded along with accompanying-paid mail advertisements, commonly known as "junk mail". Likewise, milk cartons on the breakfast table and posters displayed in high traffic areas tend to be detailed by fewer people than intended, and pictures published in the daily paper and specialized magazines may receive a brief glance by most readers.

Also, in order to create awareness in the general public about the need to locate said individuals, these orchestrated efforts rely on the public's voluntary disposition, willingness, benevolence, philanthropic tendencies, mercy for the missing, desire for justice on the antisocial, and memory retention to consciously study and retain the featured individual's resemblance, among other factors.

Fortunately, most search efforts are successful sooner or later thanks mostly to the due diligence of police departments, detectives, government organizations, non-profit organizations, special forces, private agencies and other entities. Public involvement also plays a key role and complements these organized searches as sightings of a sought person are relayed by the public to the corresponding authorities by means of a telephone call to a dedicate hotline, etc.

Nonetheless, there is a the lesser portion of efforts which are not so successful. Parents and relatives of missing victims, and the community in general; suffer the anxiety and consequences of an individual who has been missing for an unusually long period of time. Additionally, society as a whole suffers the fear, threat and potential consequences of a wanted criminal on the loose.

Even though a portion of the community becomes involved in the search efforts, it usually represents a relatively small percentage of the population, insufficient to make the efforts successful all the time, and many times the participating public fails to study the facial characteristics of the featured individual in enough detail so as to spot said individual casually.

Additionally, the process by which the individual's image and/or data is-compiled, printed on the selected media (poster, flyer, milk carton, etc.), the media processed, the hardcopy produced, transported, distributed, delivered and finally placed in front of a potentially true volunteer requires a significant effort and mobilization of resources which translate into expenses which are ultimately absorbed by the general public in the form of taxes or other payments.

As can be seen, several types of methods have been proposed and implemented in the crusade for the location and recovery or capture of sought persons. One of the main goals of these methods has been to involve the community in the search efforts to locate these individuals in order to complement organized searches and thereby increase the success rate of these efforts. Some of the mentioned initiatives may have certainly improved the success rate to some degree, but nevertheless all methods and media devices heretofore known for locating sought persons suffer from a number of disadvantages:

(a) They lack control over the public's disposition to consciously study the featured individual's resemblance and facial features.

(b) To motivate individuals to volunteer, all these efforts rely mostly on the philanthropy instincts, feelings of mercy, desire for justice, and/or the disinterested goodwill of the public among other factors, qualities which may not be exactly abundant in the general public.

(c) They fail to motivate users to refer to and study the featured person's facial features repeatedly—a factor which could translate in a significant increase in retention.

(d) Even though an individual may be motivated to volunteer, contribution is usually limited to memory retention, unless said individual carries a graphic reference of the featured person being sought.

(e) Printed media devices fail to motivate volunteers to keep and carry the graphic reference given that a volunteer may overestimate own retentive capability and discard reference prematurely.

(f) The high cost tied to these efforts is unlikely to be directly funded by the recipients in view of the absence of benefits or satisfactions different to those of benevolent nature (philanthropy, goodwill, etc).

(g) The cost of printing and delivering the media is high given that it is not targeted at specific public volunteers but rather disseminated massively to the general public regardless of recipient's potential volunteer profile, resulting in an inefficient, ineffective and relatively expensive distribution.

(h) One of the most popular and most widely distributed printed media, the mailed flyer; rests in a recipient's mailbox until retrieved, thus wasting the valuable opportunity of exposing its contents to by-passers.

(i) The cost of producing and disseminating one of the most popular media, the color poster, may be very high if massive dissemination is to be achieved.

(j) All of the aforementioned media is of a passive nature, i.e., prospects receive messages without the intervention of conscious action, thereby reducing intentional and proactive involvement of the public significantly.

OBJECTS AND ADVANTAGES

Accordingly, several objects and advantages of the present invention are:

(a) Control over the public's disposition to consciously study a featured individual's resemblance and facial features, thereby increasing memory retention.

(b) To motivate individuals to volunteer, regardless of the presence of philanthropic instincts, feelings of mercy, desire for justice, and disinterested goodwill, thereby recruiting a larger number of volunteers.

(c) It urges users to refer to, and study a featured person's facial features repeatedly, thereby increasing memory retention.

(d) To motivate individuals to keep and carry a conveniently-sized graphic reference of a featured person being sought, thereby allowing on the spot verification of a sighting while increasing real alarms about actual individuals and decreasing false alarms about look-alikes.

(e) The cost tied to the effort is directly and voluntarily funded by the targeted recipients regardless of the existence of benevolent intentions such as philanthropy, mercy, desire for justice, or the general need to cooperate with the community but rather as a result of the incentive of probable economical benefit; thereby freeing monetary, human and organizational resources to cover other needs.

(f). Maximizes the opportunity to constantly expose its contents to by-passers while on display through-a vast and diverse network of points of sale.

(g) Full-color images are massively disseminated and displayed at points of sale through a vast and diverse network at fully recoverable cost, thereby maximizing exposure of featured individuals to the general public while minimizing or eliminating printing and distribution costs altogether.

(h) The entertainment nature and game mechanic of the lottery card device urges users to become proactively involved in reception of the message, thereby increasing intentional involvement of the public significantly.

(i) The lottery card allows the display of images and other data about a featured individual to a user and through the game mechanics urges said user to learn a featured individual's facial resemblance and other data, thereby increasing public awareness.

Further objects and advantages are to provide an inexpensive method which can be used to disseminate data about sought individuals, which can stimulate public awareness about said individuals in order to increase the likelihood of locating said individuals, and which can encourage the public to fund said efforts voluntarily and directly. Still further objects and advantages will become apparent from a consideration of the ensuing description and drawings.

DRAWING FIGURES

REFERENCE NUMERALS IN DRAWINGS

| | | | |
|---|---|---|---|
| 10 | body | 12 | indicia |
| 14 | play area | 16 | opaque coat |
| 18 | linear perforation | 20 | play symbols |
| 22 | prizes | 24 | stub |
| 26 | play portion | 28 | entry code |

SUMMARY

In accordance with the present invention a method of increasing the likelihood of locating sought individuals comprises the inclusion of images and other data about such individuals on lottery game cards in such a way as to disseminate data and stimulate public awareness about such individuals.

DESCRIPTION—FIGS. 1 TO 5

A portion of the disclosure of this patent document contains material which is subject to (copyright or mask work) protection. The (copyright or mask work) owner has no objection to the facsimile reproduction by anyone of the patent document or the patent disclosure, as it appears in the Patent and Trademark Office patent file or records, but otherwise reserves all (copyright or mask work) rights whatsoever.

Figure 1:
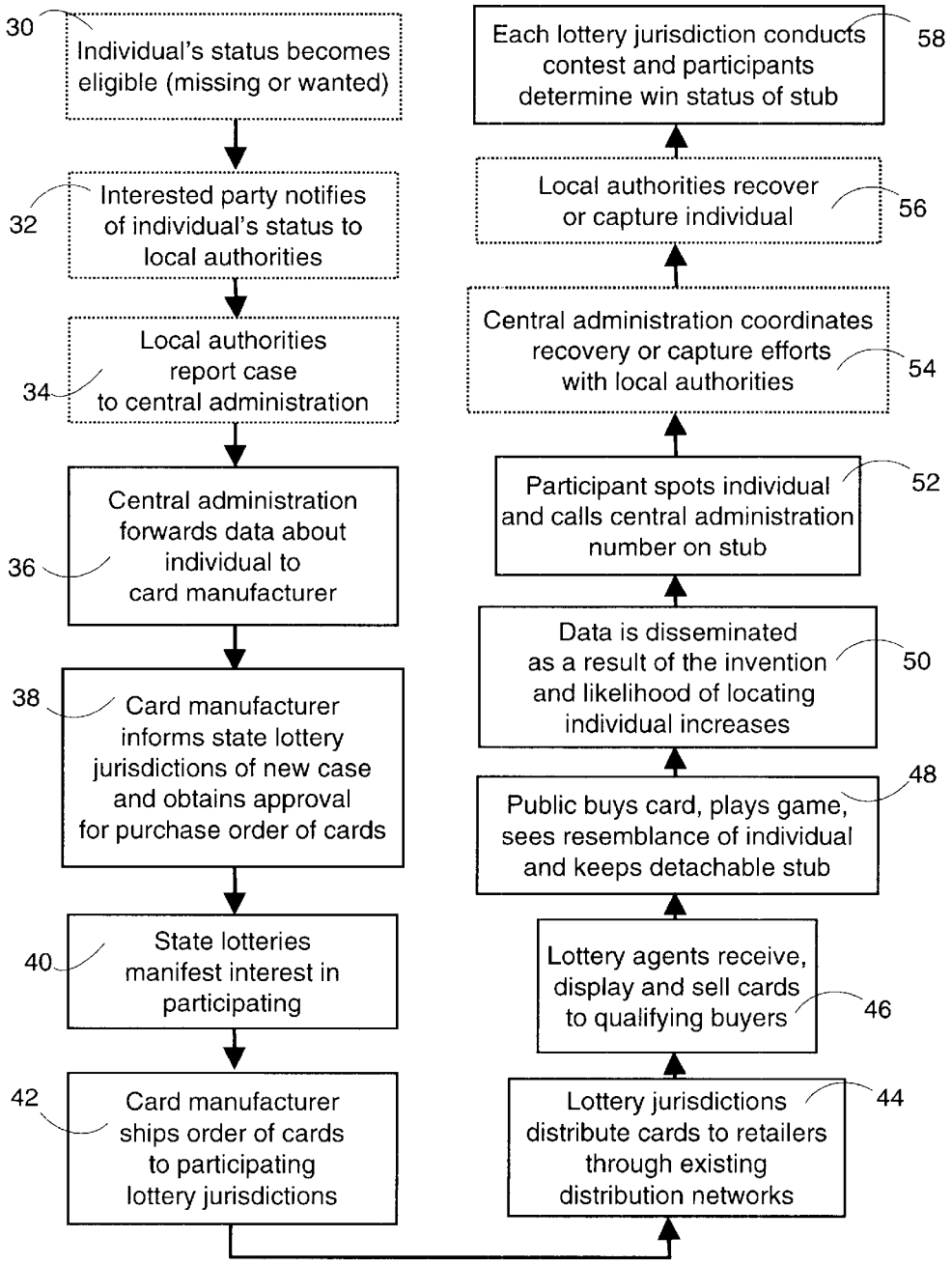
FIG. 1 shows a flowchart of the process whereby the method of the present invention serves to increase likelihood of locating individuals of interest.
Figure 2:
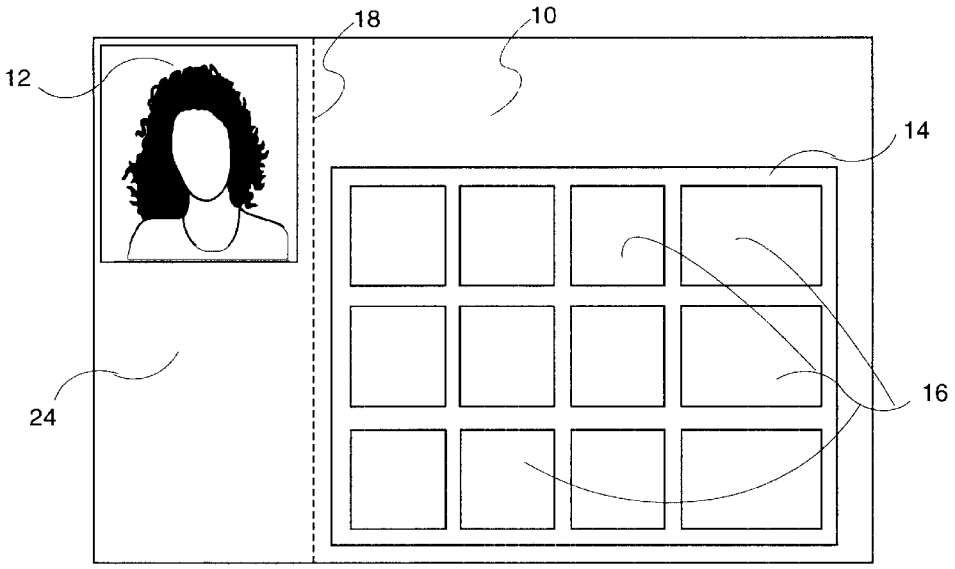
FIG. 2 shows the front of an unused lottery card with graphic indicia of an individual and a plurality of hidden indicia covered with A removable material.

A typical flowchart describing a series of 15 steps of the preferred embodiment of the process of the present invention is illustrated in FIG. 1. A typical embodiment of the lottery card of the present invention is illustrated in FIG. 2 (front view), FIG. 3 (front view), FIG. 4 (front view, stub detached from play area portion), and FIG. 5 (back view, stub detached from play area portion).

The preferred embodiment of the lottery game card of the present invention has a body 10 of typically rectangular shape and made of any material typically utilized in the manufacture of lottery game cards such as cardboard or aluminum foil. Said card has a linear perforation 18 disposed along an entire length of body 10 and typically parallel to a side of and from a predetermined distance from an edge of said body 10. Printed on a surface of a portion or stub 24 of body 10 is a set of data or indicia 12 typically comprised of graphic images or photographs and/or other data of an individual. Stub 24 is detachable from body 10 of the card along perforation 18. A remaining play area 14 of typically larger area than that of stub 24 contains a plurality of game elements comprising a multitude of play symbols 20 and prize amounts 22, covered by an opaque coat 16 of removable material typically consisting of a latex compound. The multitude of game elements consisting of play symbols 20 and prizes 22 is typically printed on play area 14 of body 10 and can consist of numbers, letters, drawings, graphics, symbols, line drawings, images or any other subject matter or combination thereof. In the preferred embodiment of the invention, play symbols 20 are associated to indicia 12 as it relates to the mechanics of use of the lottery card.

OPERATION—FIGS. 1 TO 5

The manner of following the method and using the lottery game card of this invention to increase public awareness about sought individuals comprises a series of steps, some of which are similar and some of which are different to the steps traditionally followed in other methods used toward achieving the purpose of locating sought individuals.

The flowchart in FIG. 1 illustrates a series of traditional steps 30, 32 and 34 that form part of the traditional process and typically happen prior to the steps of the process of the present invention, included here for reference purposes only. Following in sequence after said steps of the process, are steps 36 to 52 which constitute the preferred embodiment of the method of this invention. Then, steps 54 to 56 also belong to the traditional process and are included here solely for reference purposes. Finally, step 58 constitutes part of and ends the process of the method of the present invention. For clarity purposes, in the flowchart of FIG. 1, those steps of the traditional process are boxed in broken line, while those that are intrinsic to the process of the method of the present invention are boxed in solid line.

The method is as follows: In a first step 30, an individual's status becomes eligible, i.e., missing or wanted. Then, in step 32 an interested party notifies of individual's status to local authorities. In step 34 local authorities report case to a central administration in charge of administering processes for locating such individuals. At this point, the method of this invention introduces a series of new steps into the process. In step 36 the central administration forwards case data about said individual to a lottery game card manufacturer, such as OBERTHUR GAMING TECHNOLOGIES OGT, or SCIENTIFIC GAMES INTERNATIONAL SGI. Next, in step 38, lottery game card manufacturer informs state lottery jurisdictions about new case and obtains approval for purchase order of cards. State lotteries manifest intent to participate in process as described in step 40. Lottery game card manufacturer manufactures and supplies cards to participating state lotteries in step 42, each of which distributes game cards to retailers in their jurisdictions through existing distribution networks, as step 44. Retail lottery agents receive, display and sell game cards in step 46 to qualifying buyers. Then in step 48, public buys card, plays the game following instructions printed thereon and sees resemblance of featured individual.

The manner of using a typical embodiment of the lottery game card of this invention, seen in FIG. 2, is similar in play mechanics to that of existing lottery game cards but different in some ways. Namely, one first removes opaque coat 16 from a play area 14 to reveal a plurality of game elements. Said game elements can be seen in FIG. 3, and are typically comprised of a multitude of play symbols 20 and prizes 22.

Once coat 16 is removed, payer can determine win status of card. Win status of each card can be predetermined prior to and during the printing process by the manufacturer, or can be controlled by player-made choices with respect to uncovering only play symbols that are potential winners such as in those probability games described, for example, in U.S. Pat. No. 5,931,467 to Kamille (1999).

Figure 3:
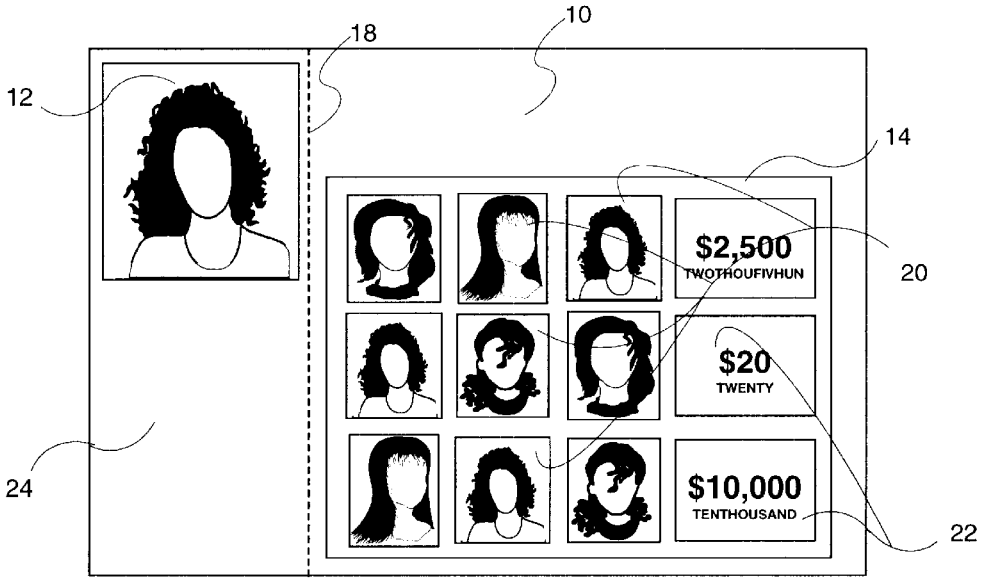
FIG. 3 shows the front of a lottery card without the removable coat and showing indicia otherwise hidden thereunder.
Figure 4:
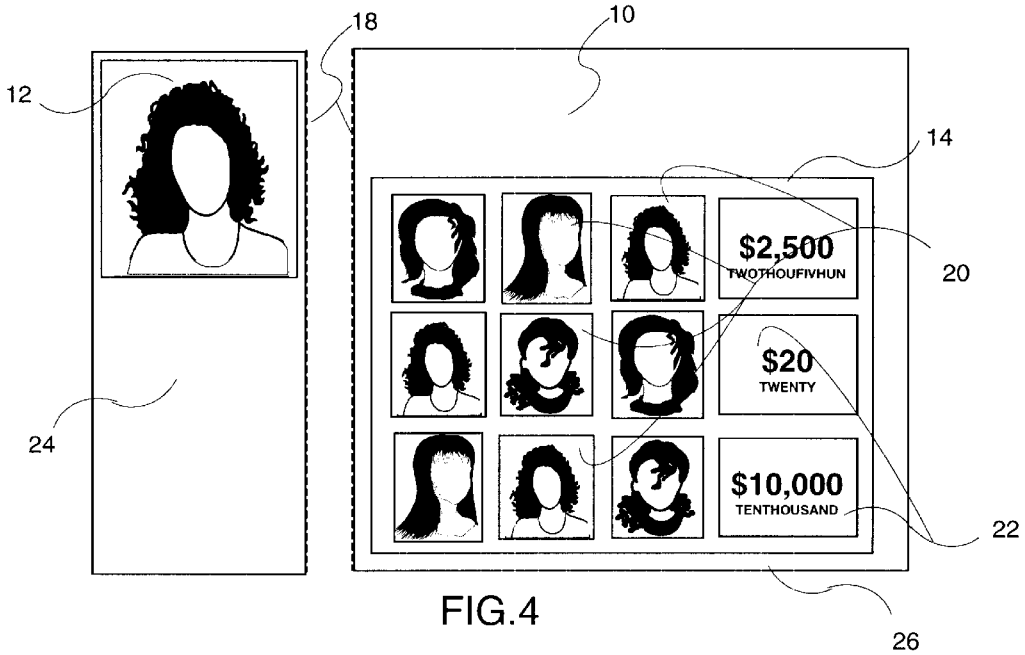
FIG. 4 shows the front of a lottery card without the removable coat and separated into 2 portions.

Next, one detaches and keeps stub 24, shown attached in FIG. 3 and detached in FIG. 4; for later reference and use, along a perforation 18. Stub 24 contains a picture or indicia 12 seen in FIG. 4 consisting of images and other data of a featured individual, and an entry code 28, seen in FIG. 5; for later use. Then one presents winning play portion 26 of card to a redeeming agent to claim prize, or discards non-winning play portion 26. Win status of play portion 26 can be made to be verifiable by means of separate secure gaming ticket validation methods using information stored thereon, such as that proposed, for example, in U.S. Pat. Nos. 5,935,000 to Sanchez III et al. (1999), or U.S. Pat. No. 5,499,816 to Levy (1996). Thus, win status of play portion 26 can be verified regardless of said play portion 26 being attached to stub 24, or independently of being presented simultaneously with said stub 24.

Figure 5:
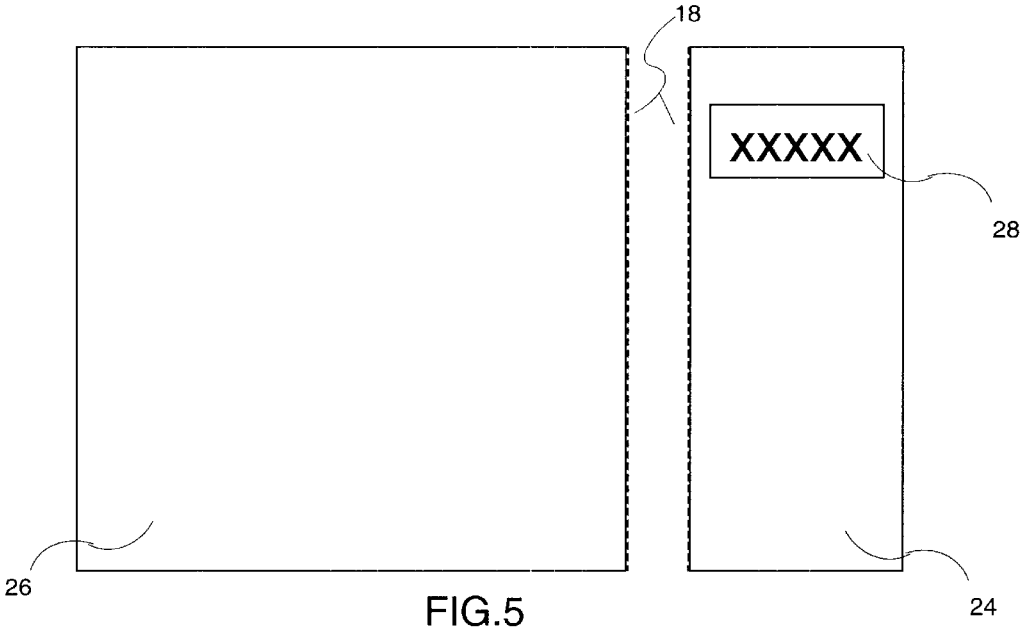
FIG. 5 shows the back of a separated card with stub area containing entry code for future draw.

Stub 24 acts as a vehicle for an additional opportunity to participate in a later contest by means of entry code 28 printed thereon, seen in FIG. 5, urging holder to keep said stub 24.

Step 48 of the process described in FIG. 1, leads to step 50, where data about a featured individual is disseminated among the public and likelihood of locating said individual is increased by at least a proportion equivalent to the plurality of users seeing indicia 12 and/or keeping said stub 24. In step 52 one makes use of stub 24 whereupon seeing and recognizing a featured individual, one may verify a match by referring to said stub 24 and call a telephone number indicated thereon, contacting directly the aforementioned central administration in charge of administering processes for locating such individuals.

Then, steps 54 contemplates the central administration coordinating efforts of recovery or capture of individual with local authorities in step, who recover or capture the individual in step 56.

Finally in step 58 each lottery jurisdiction conducts contest and participants determine win status of stub 24 using entry code number 28. In the preferred embodiment of the method of this invention, the additional opportunity to win prizes using entry code number 28 printed on stub 24 of card takes place after featured individual has been recovered or captured, thereby ensuring that said stubs are not discarded until then.

CONCLUSION, RAMIFICATION, AND SCOPE

Accordingly, the reader will see that the method of this invention can be used to stimulate public awareness about sought individuals effectively through the dissemination of data about such individuals on lottery game cards thereby increasing the likelihood that someone will spot such individual and ultimately lead to their recovery or capture. Furthermore, the preferred embodiment of the present invention comprises a feature designed to persuade users to detach and keep a stub containing the information of interest toward the location of the featured individual under the incentive of an additional opportunity to win at a later date.

In addition, the cost of the process by which the featured individual's image and other data is retrieved, compiled, organized, printed, produced, transported, distributed, delivered and finally placed in frog of a user is fully and voluntarily funded by the end-user, freeing monetary resources from all other entities, public or private.

Although the description above contains many specificities, these should not be construed as limiting the scope of the invention but as merely providing illustrations of some of the presently preferred embodiments of this invention. For example, the process could include additional or fewer steps, the card could have other shapes, such as round,.trapezoidal, triangular, etc.; data about more than one individual could be featured on said lottery card; the stub could contain code numbers for more than one additional opportunity to win prizes, etc.

Thus, the scope of the invention should be determined by the appended claims and their legal equivalents, rather than by the examples given.

I claim:

1. A method of stimulating public awareness about sought individuals by playing a lottery game comprising the steps of:

providing a plurality of lottery game cards;

including data about said individuals on each of said lottery game cards; and distributing the lottery games cards to participants in the public, wherein the data in the lottery game cards is disseminated to the public increasing the likelihood of locating said individuals.

* * * * *